US009480354B2

(12) United States Patent
Eden

(10) Patent No.: US 9,480,354 B2
(45) Date of Patent: Nov. 1, 2016

(54) GARMENT HANGER

(71) Applicant: Charles Eden, Atlanta, GA (US)

(72) Inventor: Charles Eden, Atlanta, GA (US)

( * ) Notice: Subject to any disclaimer, the term of this patent is extended or adjusted under 35 U.S.C. 154(b) by 394 days.

(21) Appl. No.: 14/085,878

(22) Filed: Nov. 21, 2013

(65) Prior Publication Data

US 2015/0136814 A1 May 21, 2015

(51) Int. Cl.
*A47G 25/14* (2006.01)

(52) U.S. Cl.
CPC ..... *A47G 25/1407* (2013.01)

(58) Field of Classification Search
CPC ..... A47G 25/1407; A47G 25/14; A47G 25/1414; A47G 25/1421; A47G 25/1428; A47G 25/1435; A47G 25/1442; A47G 25/16; A47G 25/18; A47G 25/28
See application file for complete search history.

(56) References Cited

U.S. PATENT DOCUMENTS 1,348,952 A * 8/1920 Landry ..... A47G 25/1407 40/322
3,124,284 A 3/1964 Collum
4,333,590 A * 6/1982 Princiotta ..... G09F 3/18 223/85
4,620,651 A 11/1986 Spies
4,886,010 A 12/1989 Stutzman
5,381,938 A * 1/1995 Vasudeva ..... A47G 25/1407 223/85
5,499,466 A 3/1996 House
5,526,968 A 6/1996 Larson
5,564,361 A 10/1996 Satterwhite
7,246,730 B2 7/2007 Russo
7,334,359 B1 2/2008 Palmer
8,069,595 B2 12/2011 Aiezza
8,534,513 B1 * 9/2013 Dixon ..... A47G 25/1407 223/88
2002/0066757 A1 * 6/2002 Lee ..... A47G 25/1407 223/85
2005/0224532 A1 * 10/2005 Russo ..... A47G 25/1407 223/85

* cited by examiner

*Primary Examiner* — Shaun R Hurley
*Assistant Examiner* — Andrew W Sutton
(74) *Attorney, Agent, or Firm* — Jones IP Law, LLC; Dennis W. Jones

(57) ABSTRACT

A garment hanger provides a hanger frame with a hook portion and two shoulder sections extending from a base of the hook portion toward opposite ends of a trouser rod that extends between the ends of the shoulder sections, at least one indicator rod substantially parallel to the trouser rod and extending between the two shoulder sections, indicia located on each indicator rod and providing information related to the usage of a garment, at least one indicator located on each indicator rod and adjustable to mark a portion of the information related to the usage of the garment, and a storage compartment for containing items related to the garment and providing access to storage space via a lid.

20 Claims, 4 Drawing Sheets

GARMENT HANGER

BACKGROUND

This invention pertains to garment hangers. More particularly, this invention pertains to a garment hanger that includes a storage compartment for items related to the garment and also usage indicators for tracking the number of times and/or the most recent time a garment was worn.

People often go to their wardrobe intending to select a garment and are unsure whether a particular garment has been recently cleaned. People can also be uncertain when a garment was last worn. It is often desirable not to wear the same outfit too often, or to not always wear the same shirt and tie with a particular suit for example. This uncertainty can lead to under use or over use of a particular garment. Such uncertainty can also lead to garments being cleaned too often or not enough. Clothing that is not needed as often or not needed due to climate conditions are especially prone to under or over utilization. What is needed is a better way to keep track of and utilize garments more efficiently.

BRIEF SUMMARY

According to one embodiment of the present invention, a garment hanger is provided. The garment hanger comprises (1) a hanger frame with a hook portion and two shoulder sections extending from a base of the hook portion toward opposite ends of a trouser rod that extends between the ends of the shoulder sections, (2) at least one indicator rod that is substantially parallel to the trouser rod and extends between the two shoulder sections, (3) indicia located on each indicator rod and providing information related to the usage of a garment, (4) at least one indicator located on each indicator rod and adjustable to mark a portion of the information related to the usage of the garment, and (5) a storage compartment for containing items related to the garment and having a lid. The storage compartment includes a window for inserting a label that is visible through the window.

In one embodiment, the hanger frame is formed as a single piece. In another embodiment, the hanger frame and each indicator rod are formed as a single piece. In another embodiment, the hanger frame and each indicator road are formed as a single piece of molded plastic.

In one embodiment, each indicator rod includes at least one notch opposite the indicia, for securing each indicator into position.

In one embodiment, the lid of the storage compartment is hinged opposite the hook portion of the hanger frame.

In one embodiment, the indicia include at least one of a listing of days of the week, a listing of months, a listing of dates, and a listing of numerals for a count.

In one embodiment, a support section extends between the shoulder sections opposite the hook portion, and the trouser rod is attached at one end of the support so that the support section forms a clamp for securing pants to the trouser rod.

In one embodiment, the indicator wraps around the corresponding indicator rod and is secured to the indicator rod by inserting at least one end of the indicator into the corresponding groove.

In another embodiment, a garment hanger comprises (1) a hanger frame with a hook portion and two shoulder sections extending from a base of the hook portion toward opposite ends of a trouser rod that extends between the ends of the shoulder sections, (2) at least one indicator rod that is substantially parallel to the trouser rod, extends between the two shoulder sections, and includes at least one groove, (3) indicia located on each indicator rod and providing information related to the usage of a garment, (4) at least one indicator located on each indicator rod and adjustable to mark a portion of the information related to the usage of the garment by securing the respective indicator in position using the corresponding groove, and (5) a storage compartment for containing items related to the garment and providing access to storage space via a lid that is hinged opposite the hook portion of the hanger frame, the lid also having a window for inserting a label that is visible through the window.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE DRAWINGS

The above-mentioned features will become more clearly understood from the following detailed description read together with the drawings in which.

DETAILED DESCRIPTION

An improved garment hanger providing a storage compartment and usage indicators for garments is disclosed. Various embodiments provide for hanging a garment on the garment hanger while also providing storage for items related to the garment, and also for tracking the wear of a garment via date and/or times worn.

Figure 1:
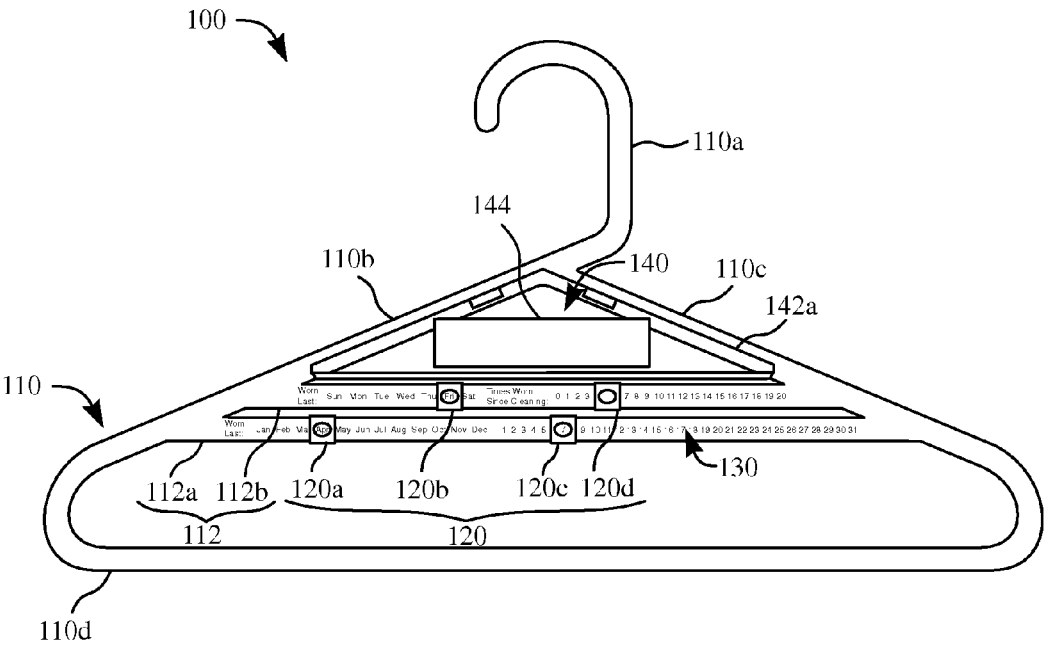
FIG. 1 is a front view of a garment hanger having a storage compartment and usage indicators.
Figure 2:
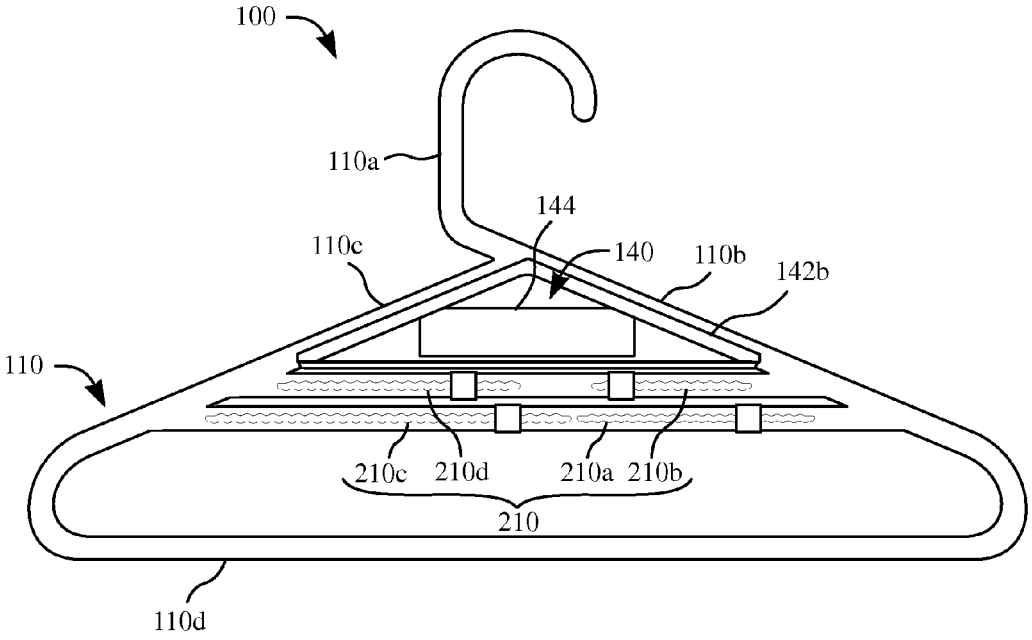
FIG. 2 is a rear view of the garment hanger.

FIG. 1 is a front view of a garment hanger 100 and FIG. 2 is a rear view of the garment hanger 100. The garment hanger 100 includes a hanger frame 110, indicator bars 112*a*, 112*b* (collectively 112), sliders 120*a*, 120*b*, 120*c*, 120*d* (collectively 120), indicia 130, and a storage compartment 140. The garment hanger 100 provides for storing buttons and other items related to a garment while also providing a mechanism for tracking the most recent wearing of a garment or a count of times worn for a garment.

The hanger frame 110 includes a hook portion 110*a* for supporting the garment hanger 100 from a closet rod, for example. Of course, the garment hanger 100 may also be supported within a garment bag, from a wall hook, or many other common uses for garment hangers 100.

Shoulder portions 110*b*, 110*c* (collectively 110) extend away from the base of the hook portion 110*a* toward either end of a trouser rod 110*d* to form a generally triangular configuration. The shoulder portions 110 are of sufficient length to provide support for garments such as suit jackets, sport coats, jackets, shirts, blouses, dresses, and the like. It should be noted that the length of the shoulder portions 110 may vary according to design choice of a particular garment hanger 100 to account for different sized garments. In some embodiments, the shoulder portions 110 are curved to approximate a shape that conforms to the actual back and shoulder areas of a person.

The trouser rod 110*d* extends between the ends of the respective shoulder portions 110 and provides support for trousers, pants, knickers, and such like. Trousers may be folded across the trouser rod 110*d* for support. In some embodiments, and as is known in the art, a support (not shown) is added to the hanger frame 110 between the ends of the shoulder portions 110*b*, 110*c*, and the trouser rod 110*d* is attached at one end to the support, and is loose at the other end so that the support is used to clamp the trousers and such like into position.

In the illustrated embodiment, two indicator bars 112*a*, 112*b* extend between the shoulder portions 110*b*, 110*c*. In one embodiment, the indicator bars 112*a*, 112*b* are substantially parallel to the trouser rod 110*d* and are situated such that the first indicator bar 112*a* is closer to the trouser rod 110*d* and is substantially halfway between the trouser rod 110*d* and the base of the hook portion 110*a*. The second indicator bar 112*b* is situated between the first indicator bar 112*a* and the hook portion 110*a*. Of course, the location of the indicator bars 112*a*, 112*b* may vary somewhat due to design considerations, whether or not a support bar is included, and the location of the storage compartment 140 (discussed further below). It should also be appreciated that although two indicator bars 112 are shown in the illustrated embodiment, any number of indicator bars 112 may be included in the garment hanger 100 according to the particular type usage and/or other indicators to be tracked.

The indicator bars 112*a*, 112*b* include indicia 130, or markings, to provide the capability to track usage of any particular garment for which the garment hanger 100 may be used. Garment usage may be tracked by the month and date, day of the week, and/or times worn since last use for example. Examples of the type indicia 130 on the indicator bars 112*a*, 112*b*, are discussed in greater detail below. The indicator bars 112*a*, 112*b* also include sliders 120*a*, 120*b*, 120*c*, 120*d* (usage indicators) for indicating usage by marking a particular day, month, date, use count, and such like according to the particular indicia 130 included.

The garment hanger 100, as shown from the rear in FIG. 2, also includes grooves 210*a*, 210*b*, 210*c*, 210*d* (collectively 210), or notches, along each indicator bar 112 generally opposite the indicia 130 for securing the sliders 120 to the indicator bars 112 and/or into place along the indicator bars 112.

The garment hanger 100 also includes a storage compartment 140 situated between the upper indicator bar 112*b*, the upper section of the respective shoulder portions 110*b*, 110*c*, and the base of the hook portion 110*a*. The storage compartment 140 is discussed in greater detail below and includes a window 144 that can enclose a label for identifying the contents, for example.

In one embodiment, the hanger frame 110 and indicator bars 112*a*, 112*b* are made from a single material that forms a single piece. In other embodiments, the indicator bars 112 may be made in a manner that attaches to a hanger frame 110 of similar material, or attached as an addition to an existing garment hanger. As noted above, the trouser rod 110*d* may also be separate from the hanger frame 110 and attached to a support (not shown) for clamping trousers and such like into place.

In the illustrated embodiment, the hanger frame 110 is made of plastic and from a mold so that the hanger frame 100 is a single piece of plastic. It is envisioned that in such an embodiment the hanger frame 110 is made of a lightweight and durable plastic. It should be noted that there are many type plastics and similar materials that are suitable for such a hanger frame 110 of the garment hanger 100.

In other embodiments, the hanger frame 110 is made from metal, metal alloys, wood, or any other material that can be formed in a manner that is suitable for the hanger frame 110 as herein described. In still other embodiments, the hanger frame 110 is formed into shapes that are suitable for the shape of the garment for which the garment hanger 100 is to be used. In some embodiments, the shoulder portions 110*b*, 110*c* are curved forward extending from the hook portion 110*a* to the distal ends of the shoulder portions 110*b*, 110*c* and approximating the shape of a person's neck and shoulder area, for example. In some embodiments, the shoulder portions 110*b*, 110*c* may also have a wider construction sloping down toward the front and back of the garment hanger 100 to prevent fold lines from forming in the garment. It is intended that such variations do not take away from or limit the functionality of the garment hanger 100 as herein disclosed.

Figure 3:
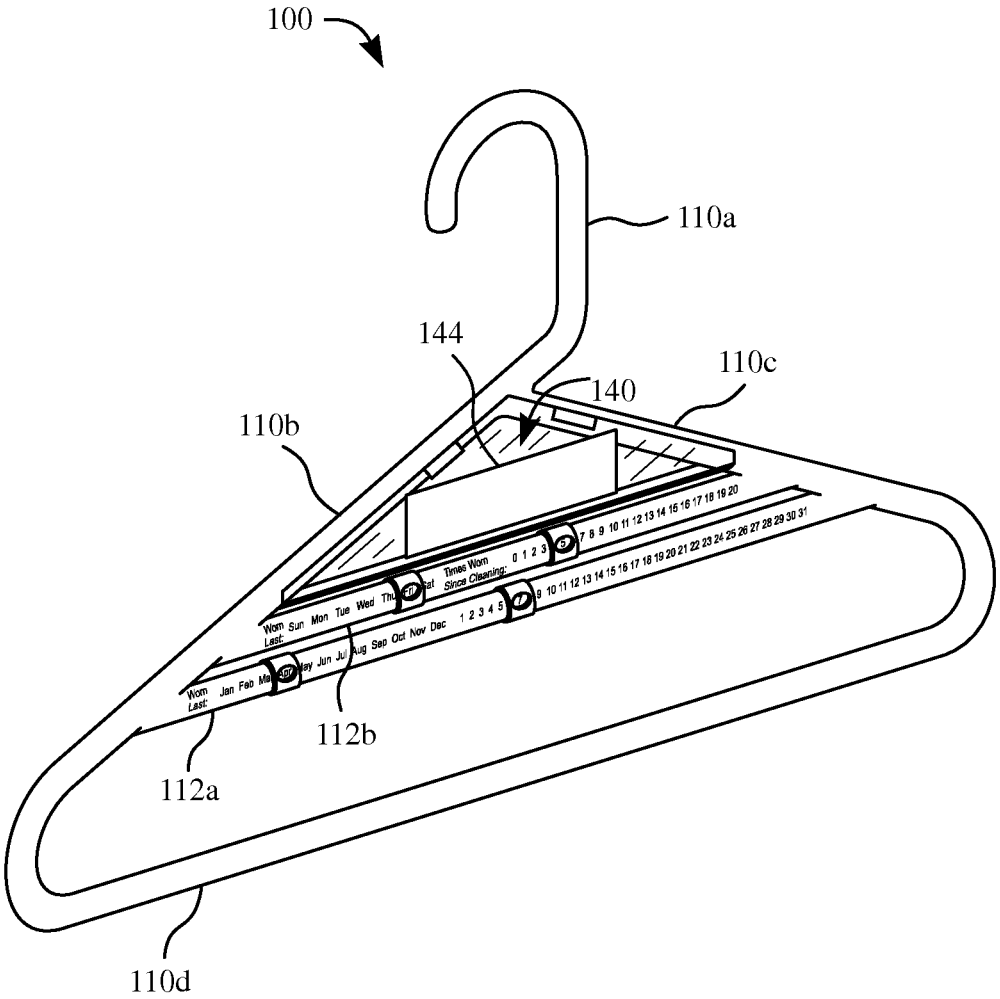
FIG. 3 is a perspective view of the garment hanger.
Figure 4:
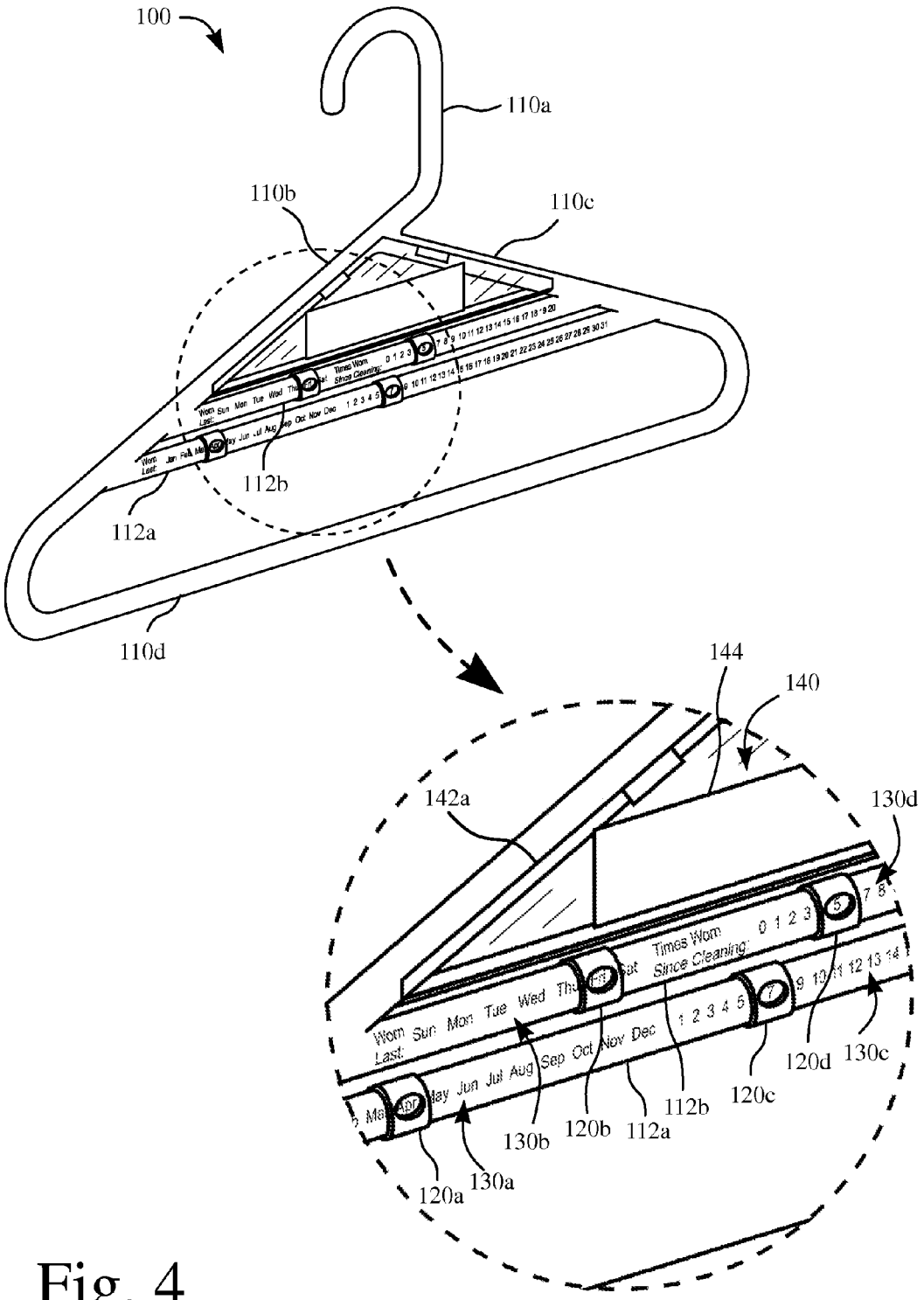
FIG. 4 is a perspective view of the garment hanger with an exploded view of the sliders.

FIG. 3 is a perspective view of the garment hanger 100 and FIG. 4 includes the same perspective view along with an exploded view illustrating a portion of the storage compartment 140 and the sliders 120 in use on the indicator bars 112. In the illustrated embodiment of the garment hanger 100, the storage compartment 140 is shown above the second indicator bar 112*b*, below the hook portion 110*a*, and between the shoulder portions 110*b*, 110*c*. There is a small amount of space between the storage compartment 140 and the second indicator bar 112*b* to provide for hinge action of the storage compartment 140. Additionally, there is a small amount of space between the first indicator bar 112*a* and the second indicator bar 112*b*. The space between the second indicator bar 112*b* and the storage compartment 140 as well as the space between the first indicator bar 112*a* and the second indicator bar 112*b* provide for ease of movement of the sliders 120 along the respective indicator bar 112.

In the embodiment illustrated by the exploded view of FIG. 4, the sliders 120 are shown in position along the indicator bars 112. The illustrated embodiment includes various indicia 130*a*, 130*b*, 130*c*, 130*d* (collectively 130 as above) illustrating months, days, date, and use count respectively, where the months are shown by indicia 130*a*, the days of the week are shown by indicia 130*b*, the date (of the month) is shown by indicia 130*c*, and the use count is shown by indicia 130*d*.

Sliders 120 are affixed to the indicator bars 112 corresponding to each of the respective indicia 130. In the illustrated embodiment, a slider 120*a* is affixed to the first indicator bar 112*a* corresponding to the months shown by indicia 130*a*. Another slider 120*b* is affixed to the second indicator bar 112*b* corresponding to days of the week shown by indicia 130*b*. Another slider 120*c* is affixed to the first indicator bar 112*a* corresponding to the date of the month shown by indicia 130*c*. Finally, another slider 120*d* is affixed to the second indicator bar 112*b* corresponding to the use count shown by indicia 130*d*. Of course, the amount and type of indicia 130 shown on the indicator bars 112 may vary according to the particular type usage and/or other indicators to be tracked.

The indicia 130 shown on the indicator bars 112 may be used to track any type usage or other indicator that a person may desire to track for garment usage. It is intended that such variations do not take away from or limit the functionality of the indicator bars 112, the indicia 130, or the garment hanger 100 herein disclosed.

The various sliders 120 are adjustable along the respective indicator bar 112*a*, 112*b* and may be positioned to highlight the particular month, day, use count, date, or any other indicia desired for tracking. In the illustrated embodiment, each slider 120*a*, 120*b*, 120*c*, 120*d* is a generally flat and circular piece that wraps around the respective indicator bar 112*a*, 112*b*. Each slider also includes an opening so that the opening reveals the highlighted indicia 130*a*, 130*b*, 130*c*, 130*d* to mark the particular month, day, use count, date, and such like. In the illustrated embodiment, the opening is a circular opening that reveals the respective indicia 130*a*, 130*b*, 130*c*, 130*d*. Of course the opening could be any shape that is suitable for revealing the respective indicia 130*a*, 130*b*, 130*c*, 130*d*.

In the illustrated embodiment, the slider 120*a* marks the month of April at indicia 130*a* on the first indicator bar 112*a*. Similarly, the slider 120*b* marks the day of Friday at indicia 130*b* on the second indicator bar 112*b*. The slider 120*c* marks the date of 7 at indicia 130*c* on the first indicator bar 112*a*. Finally, the slider 120*d* marks the use count of 5 at indicia 130*d* on the second indicator bar 112*b*. Thus, the illustrated embodiment shows that the garment was last worn on Friday, April 7, and that the garment has been worn or used 5 times since the last cleaning or other desired tracking event. Upon the next wearing of the garment for example, the use count, the day of the week, and the month and date are easily adjustable by moving the respective sliders 120 to a new day, month and date, and count, to indicate the most recent wearing and the number of times used or worn.

In one embodiment, the sliders 120 wrap around the indicator bars 112 to the grooves 210. That is, the slider 120*a* wraps around to the groove 210*a*, the slider 120*b* wraps around to the groove 210*b*, the slider 120*c* wraps around to the groove 210*c*, and the slider 120*d* wraps around to the groove 210*d*. Of course, any number of sliders 120 may be affixed to the indicator bars 112. As such, any number of grooves 210 may be notched into the rear of the indicator bars 112 for securing the sliders to the indicator bars 112. In the illustrated embodiment, the number of sliders 120 matches the number of grooves 210. In this way, the movement of the respective slider 120 is limited by the respective groove 210. It is generally expected that the number of grooves 210 correspond to the number of sliders 120, though the number of each could be more or less than the other.

It should be understood that the sliders 120 may be secured by the notches or grooves 210 in many ways. The sliders 120 may be secured into position within the grooves 210 via insertion of each end of the respective slider 120 into the notch, for example. In this way, gripping the slider 120 with slight pressure loosens the slider 120 for adjustment along the groove 210 of the indicator bar. The sliders 120 may also be secured via overlapping the opposing ends of the slider and inserting a pin or other fastener through the overlapped ends into the groove 210 of the indicator bar 112. The sliders 120 may also be formed in a circular shape having opposing ends having a stem that inserts into the groove 210. It is intended that such variations do not take away from or limit the functionality of the sliders 120 in concert with the indicator bars 112 or their use for the garment hanger 100 as herein disclosed.

In one embodiment, the sliders 120 are made from a plastic suitable for sliding along the respective indicator bar 112. In another embodiment, the sliders 120 are made from a flexible metal that is suitable for being formed in a shape that wraps around and also for sliding along the respective indicator bar 112. One such slider 120 is formed from a copper metal. It should be noted that there are many metals and alloys that are suitable for such a flexible form. In other embodiments, the sliders 120 are formed from the same material as the hanger frame 110 to facilitate the adjustment of the sliders 120 along the indicator bars 112.

The exploded view also reveals the intersection of the storage compartment 140 with the shoulder portion 110*b* of the hanger frame 110. The lid 142*a* of the storage compartment 140 is shown against the shoulder portion 110*b* in a closed position. Of course the lid 142*a* also closes against the shoulder portion 110*c* (not shown in the exploded view). It can also be seen that the window 144 is visible on the lid 142*a* of the storage compartment 140.

Figure 5:
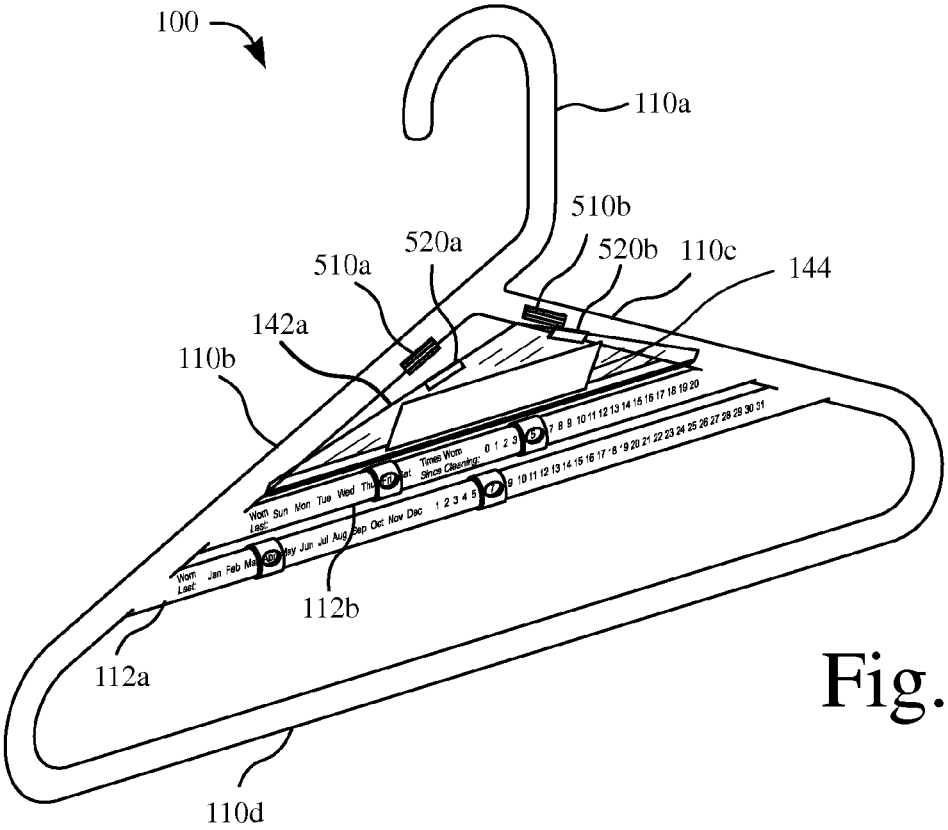
FIG. 5 is a perspective view of the garment hanger depicting the opening of the storage compartment.
Figure 6:
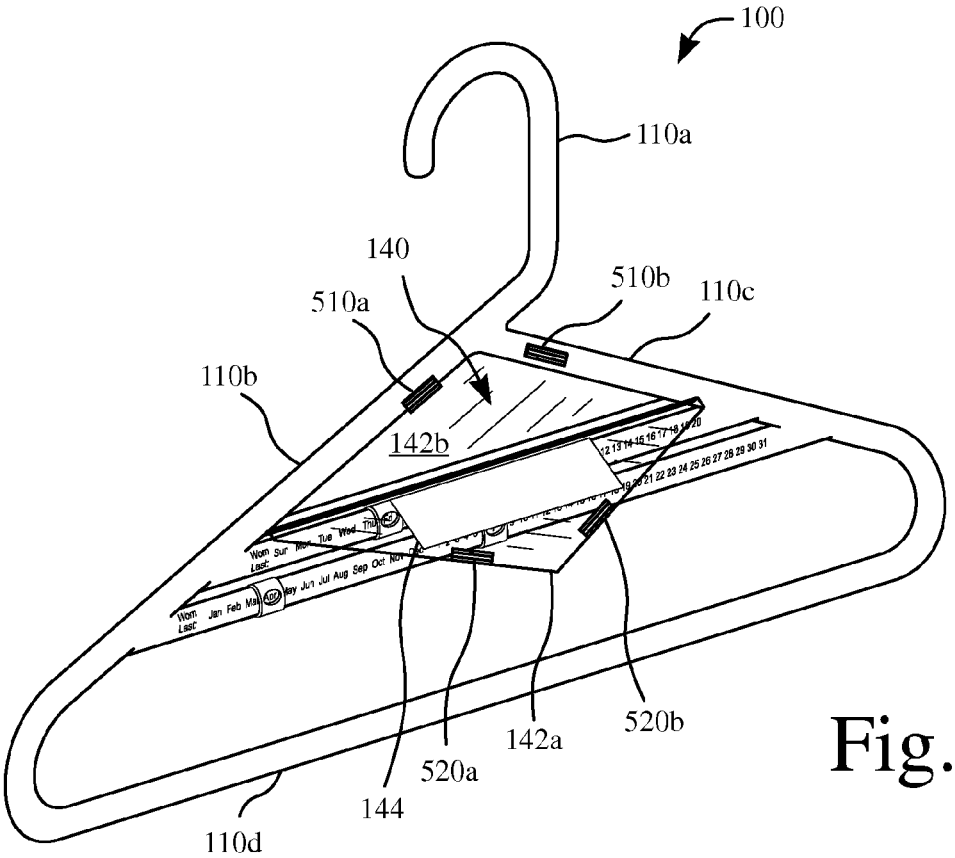
FIG. 6 is a perspective view of the garment hanger with an open storage compartment.

FIG. 5 is a perspective view of the garment hanger 100 during the opening of the storage compartment 140, and FIG. 6 is a perspective view of the garment hanger 100 with the storage compartment 140 in an open position. The storage compartment 140 includes a lid 142*a* portion (front), a back 142*b* (rear), and a window 144 for containing a label.

The storage compartment 140 is situated between the upper indicator bar 112*b*, the upper section of the respective shoulder portions 110*b*, 110*c*, and the base of the hook portion 110*a*. The storage compartment 140 provides a location for storing items related to a garment while also providing a mechanism for tracking the most recent wearing of that garment or a count of the number of times the garment has been worn. Some items that can be placed in the storage compartment 140 include spare buttons, thread, care/cleaning instructions, purchase receipt, notes such as clothing/accessories to be worn with the garment, events the garment has been worn to, material samples, tie clips, cuff links, and/or many other items related to the garment.

In FIG. 5 the lid 142*a*, or front, of the storage compartment 140 is shown in a partially open position. The lid 142*a* is hinged at the base portion of the storage compartment 140 near the second indicator bar 112*b*. In this way, the lid 142*a* folds open away from the back 142*b* of the storage compartment 140 and toward the front of the garment hanger 100. In the illustrated embodiment, the lid 142*a* includes a pair of fasteners 520*a*, 520*b* that connect with fastener receivers 510*a*, 510*b* on the shoulder sections 110*b*, 110*c* with the lid 142*a* in the closed position. In another embodiment, the lid 142*a* is formed in a fashion that snaps to the back 142*b* of the storage compartment. In yet another embodiment, the storage compartment is formed so that the back 142*b* includes curved portions extending toward the lid 142*a* so that the curved portions fit against the curves of the shoulder sections 110*b*, 110*c* of the hanger frame and the storage compartment 140 snaps into place between the shoulder sections 110*b*, 110*c* and the indicator bar 112*b*. It should be noted that there are many ways in which the lid 142*a* may be secured to the back 142*b* of the storage compartment. It is intended that such variations do not take away from or limit the functionality of the storage compartment 140 or its use in the garment hanger 100 as herein disclosed.

In FIG. 6 the lid 142*a* is shown in a fully open position to reveal the inside of the storage compartment 140. As shown in the illustrated embodiment, the storage compartment 140 is formed of a transparent or see-through type plastic so that any contents of the storage compartment 140 are also visible through the container without opening the lid 142*a*. In one such embodiment, both the back 142*b* and the lid 142*a* are transparent plastic. In another embodiment, the storage compartment 140 is formed of an opaque plastic so that any contents are not visible from outside the container.

In yet another embodiment, the storage compartment 140 includes an opaque back 142*b* with a transparent lid 142*a*. In still another embodiment, the storage compartment 140 is made from a plastic that matches the hanger frame 110 of the garment hanger 100.

The lid 142*a* of the storage compartment 140 also includes a transparent window 144 for inserting a label, for example. The label can be used to identify the contents that are placed into the storage compartment 140, or to identify the clothing, or any other important information. In one embodiment, the window 144 is open to the inside of the storage compartment so that a label is inserted from the inside of the lid 142*a*. In another embodiment, the window 144 is open to the outside of the storage compartment so that a label is inserted from the outside of the lid 142*a*. In either the case the window 144 is transparent so that the contents on a label are clearly visible from the front of the lid 142*a*.

From the foregoing description, it will be recognized by those skilled in the art that an improved garment hanger 100 providing a storage compartment 140 and usage indication for garments in the form of sliders 120 to mark the indicia 130 on indicator bars 112 of the garment hanger 100 is disclosed. Various embodiments provide for hanging a garment on the garment hanger 100 while also providing storage for items related to the garment, and also for tracking the wear of a garment via date and/or times worn.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

What is claimed is:

1. A garment hanger comprising:

a hanger frame comprising a hook portion and two shoulder sections extending from a base of the hook portion toward opposite ends of a trouser rod, the trouser rod extending between the ends of the shoulder sections;

at least one indicator rod, the at least one indicator rod substantially parallel to the trouser rod and extending between the two shoulder sections, each at least one indicator rod further including at least one groove;

at least one set of indicia located on the at least one indicator rod, each set of indicia providing information related to the usage of a garment;

at least one indicator located on each at least one indicator rod, each indicator adjustable to mark a portion of the information related to the usage of the garment, and each indicator wrapped around the corresponding indicator rod and securable to the indicator rod, at least one end of the indicator inserted into the corresponding groove in the indicator rod; and a storage compartment for containing items related to the garment, the storage compartment providing access to storage space via a lid.

2. The garment hanger of claim 1, the storage compartment further comprising a window for inserting a label wherein the label is visible through the window.

3. The garment hanger of claim 1, wherein the hanger frame is formed as a single piece.

4. The garment hanger of claim 3, wherein the hanger frame and the at least one indicator rod are formed as a single piece.

5. The garment hanger of claim 4, wherein the hanger frame and the at least one indicator rod are formed as a single piece of molded plastic.

6. The garment hanger of claim 1, each at least one groove in the at least one indicator rod further being situated opposite a respective set of indicia, for securing each at least one indicator into position.

7. The garment hanger of claim 1, wherein the lid is hinged opposite the hook portion of the hanger frame.

8. The garment hanger of claim 1, wherein the indicia include at least one of a listing of days of the week, a listing of months, a listing of dates, and a listing of numerals for a count.

9. A garment hanger comprising:

a hanger frame comprising a hook portion and two shoulder sections extending from a base of the hook portion toward opposite ends of a trouser rod, the trouser rod extending between the ends of the shoulder sections;

at least one indicator rod, the at least one indicator rod substantially parallel to the trouser rod and extending between the two shoulder sections, each at least one indicator rod further including at least one groove;

at least one set of indicia located on the at least one indicator rod, the indicia providing information related to the usage of a garment, each set of indicia situated opposite each at least one groove in the at least one indicator rod;

at least one indicator located on each at least one indicator rod, each indicator wrapped around the corresponding indicator rod and securable to the indicator rod, at least one end of the indicator inserted into the corresponding groove in the indicator rod, and each indicator adjustable to mark a portion of the information related to the usage of the garment via securing the respective indicator in position using the corresponding groove; and a storage compartment for containing items related to the garment, the storage compartment providing access to storage space via a lid that is hinged opposite the hook portion of the hanger frame, the lid further comprising a window for inserting a label wherein the label is visible through the window.

10. The garment hanger of claim 9, wherein the hanger frame is formed as a single piece.

11. The garment hanger of claim 10, wherein the hanger frame and the at least one indicator rod are formed as a single piece.

12. The garment hanger of claim 11, wherein the hanger frame and the at least one indicator rod are formed as a single piece of molded plastic.

13. The garment hanger of claim 9, wherein the indicia include at least one of a listing of days of the week, a listing of months, a listing of dates, and a listing of numerals for a count.

14. The garment hanger of claim 1, wherein each indicator is slidable along a respective groove within a respective indicator rod.

15. The garment hanger of claim 9, wherein each indicator is slidable along a respective groove within a respective indicator rod.

16. A garment hanger comprising:

a hanger frame comprising a hook portion and two shoulder sections extending from a base of the hook portion toward opposite ends of a trouser rod, the trouser rod extending between the ends of the shoulder sections;

at least one indicator rod, the at least one indicator rod substantially parallel to the trouser rod and extending between the two shoulder sections, each at least one indicator rod further including at least one groove;

at least one set of indicia located on the at least one indicator rod, each set of indicia providing information related to the usage of a garment; and at least one indicator located on each at least one indicator rod, each indicator adjustable to mark a portion of the information related to the usage of the garment, and each indicator wrapped around the corresponding indicator rod and securable to the indicator rod, at least one end of the indicator inserted into the corresponding groove in the indicator rod.

17. The garment hanger of claim 16, wherein the hanger frame is formed as a single piece.

18. The garment hanger of claim 17, wherein the hanger frame and the at least one indicator rod are formed as a single piece.

19. The garment hanger of claim 16, each at least one groove in the at least one indicator rod further being situated opposite a respective set of indicia, for securing each at least one indicator into position.

20. The garment hanger of claim 16, wherein each indicator is slidable along a respective groove within a respective indicator rod.

* * * * *